United States Patent [19]

Davidson

[11] Patent Number: 4,813,083

[45] Date of Patent: Mar. 21, 1989

[54] HELMET VISOR WITH WATER STORAGE

[76] Inventor: Rodney Davidson, 24707 Cypress St., Lomita, Calif. 90717

[21] Appl. No.: 97,726

[22] Filed: Sep. 17, 1987

[51] Int. Cl.[4] ..... A42B 3/02

[52] U.S. Cl. ..... 2/422; 2/12

[58] Field of Search ..... 2/9, 171.2, 424, 425, 2/429, 12, 410, 422; 350/312

[56] References Cited

U.S. PATENT DOCUMENTS

| | | | |
|---|---|---|---|
| 3,344,434 | 10/1967 | Beckmann et al. | 2/8 |
| 3,841,740 | 10/1974 | Lacy | 350/312 X |
| 3,914,027 | 10/1975 | Caron | 350/312 X |
| 4,369,782 | 1/1983 | McGee | 2/410 X |
| 4,626,247 | 12/1986 | Frankel | 2/425 X |
| 4,744,107 | 5/1988 | Fohl | 2/422 |

FOREIGN PATENT DOCUMENTS

| | | | |
|---|---|---|---|
| 2338005 | 9/1977 | France | 2/424 |
| 2584894 | 1/1987 | France | 2/425 |
| 2082896 | 3/1982 | United Kingdom | 2/425 |

*Primary Examiner*—Wm. Carter Reynolds
*Attorney, Agent, or Firm*—Singer & Singer

[57] ABSTRACT

There is described a hollow visor capable of being removably attached to a safety helmet of the type used by motorcycle riders. The visor is filled with water and sealed. One end of small tube extends into the hollow portion of the visor with the other end of the tube removably attached to the open face portion of the visor, thereby allowing the user to hold the open end of the flexible tube in his mouth. The visor is particularly useful for racing drivers by allowing the user to keep his mouth moist without taking his hands off the controls. The water will not leak from the visor since it is sealed and must be drawn out by the user.

11 Claims, 1 Drawing Sheet

HELMET VISOR WITH WATER STORAGE

This invention relates to a helmet accessory suitable for use by motorcycle racing drivers who have a need to keep their mouth moist while racing their vehicles without removing their hands from the handlebars.

There is described a hollow visor capable of holding a small amount of fluid. The visor is removably connected to a safety helmet always worn by racing drivers and is connected in the same fashion as other accessory visors are connected to the helmet.

In the preferred embodiment, a removeable sealing cover is located on the visor for allowing the user to fill the visor with fluid. A flexible tube has one end located within the visor and the other end adapted to be placed in the mouth of the rider thereby allowing the user to draw the water from the visor without removing his hands from the handlebars.

The attaching points between the visor and the helmet are purposely weakened in order to allow the visor to separate from the helmet in the event of an accident which unfortunately frequently happens during a contested race. The visor is preferably attached to the helmet in a fixed spaced apart relationship which allows air passage between the visor and the helmet which reduces wind pressure on the visor during a race. Without the air passage, the visor would tend to catch the wind and pull the helmet off the rider. In the preferred embodiment, the open end of the flexible tube contains a shoulder portion for allowing the user to hold the flexible end in this mouth without removing his hands from the handlebars. The flexible tube is removably attached to the contour portions of the open face of the helmet thereby insuring that the tube does not move about and interfere with the vision of the rider.

In the motorcycle racing art it has become customary to provide races in sandy and dirty conditions which usually last no more than 30 minutes. These so called motorcross races require great physical exertion by the rider and place a great strain on the physical endurance of the rider who should be in good physical condition. In addition, these races usually take place during the day under hot sweaty conditions which results in dehydration and the need to replace water lost by evaporation.

The visor, which is the subject matter of the present invention, allows the motorcycle racer to keep the tube in his mouth and draw water from the visor during the race without removing his hands from the handlebars. The typical visor will hold between 8 and 10 oz. of water which is more than sufficient for a normal 30 minute motorcross event. This allows the rider to be more mentally efficient and better equipped to handle the demands of a hotly contested motorcycle race.

A review of the prior art shows different applications of utilizing a water liner in combination with a helmet as a means of cooling the rider; however, there is nothing in the prior art which actually allows the rider to take a small drink and keep his mouth moist while riding his vehicle.

A review of the prior art shows U.S. Pat. No. 4,551,858 entitled "Protective Helmet Having A Cooling Harness" which discloses an insert to be used within a helmet and in which the insert is formed into cells for receiving a coolant. The theory is to provide a means for cooling the head of the rider underneath the helmet. The water is not available for drinking.

A review of U.S. Pat. No. 4,138,743 entitled "Liquid Cooled Helmet" discloses a liquid cooled helmet comprising a cap of flexible material adapted to fit the head of a person. The cooling panels are adapted to receive a coolant and in this way, keep the head of the user comfortable and cool under the more formal helmet structure.

An earlier patent entitled "Ventilator And Medicament Or Perfume Container For Hats" issued Oct. 5, 1909 an assigned U.S. Pat. No. 935,832 discloses a hat having a panel portion adapted to receive a coolant or perfume that can be released according to the needs of the user.

A novelty device entitled "Novelty Advertising Cap" issued May 6, 1986 under U.S. Pat. No. 4,586,280 discloses a cap having a spigot and a cup portion in which appears to dispense fluid from the spigot into a cup as a means of advertising a liquid drink. The system operates by battery power and is used primarily as a novelty for advertisement purposes.

Last but not least, U.S. Pat. No. 4,484,363 entitled "Combination Hat And Cooling Device" discloses a hat in combination with a sealed container filled with a coolant and used to cool the brow of the wearer of the hat. In this case, there is no release of the fluid but it is used only for cooling the user.

These prior art devices should be compared with the present invention, where a source of drinking fluid is stored in the visor and is made available to the wearer of the helmet while riding the vehicle and without removing his hands from the handlebars.

Further advantages will be made more apparent by referring now to the accompanying drawings wherein.

It is well known and appreciated that all racing participants wear helmets of different sizes and configurations. All present day helmets are designed to protect the head of the rider against impact forces and danger in the event of a spell or fall. Helmets of these types contain attachment points for attaching visors, sun-shields and moveable guards which are universally available for helmets of all sizes.

Figure 1:
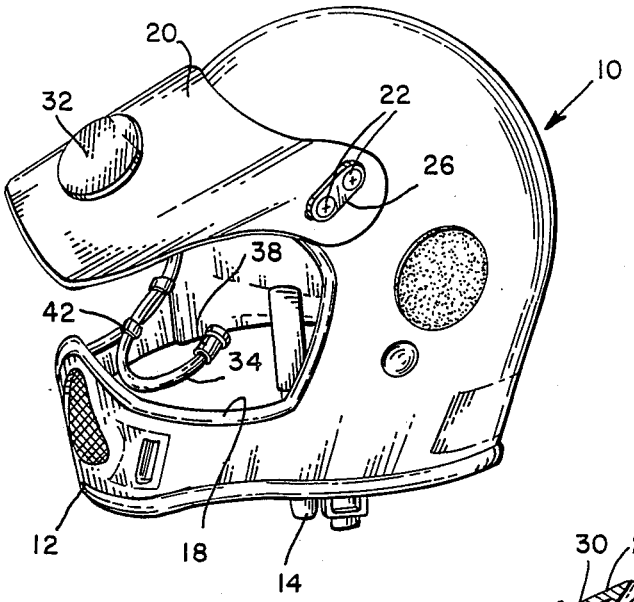
FIG. 1 is a perspective drawing illustrating a hollow visor attached to a conventional helmet.
Figure 2:
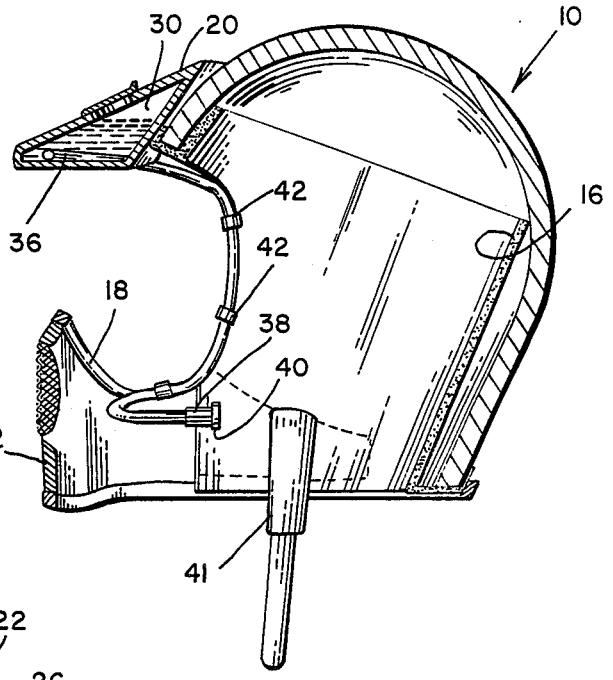
FIG. 2 is a cross section of the helmet illustrated in FIG. 1.
Figure 3:
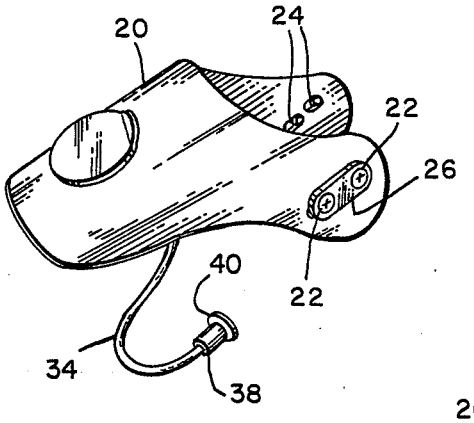
FIG. 3 is a perspective view of a visor constructed according to the principles of the present invention.
Figure 4:
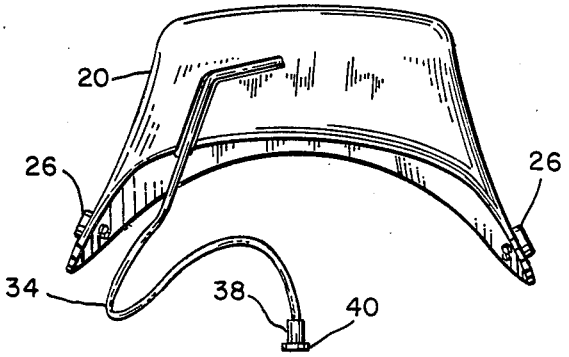
FIG. 4 is a bottom view of the visor illustrated in FIG. 3.

Referring now to FIGS. 1 and 2 there is shown a helmet 10 having a conventional construction and including a nose guard portion 12 and chin strap 14. The inside of the helmet contains a suitable liner 16 and the front piece of the helmet 10 contains a contour cut out 18.

A visor 20 having the same general contour as the helmet 10 is removable attached to each side of the helmet by means of screws 22 that are adapted to pass through suitable openings in the visor 20 for attachment to the helmet 10. The holes 24 are generally constructed larger than necessary in order to provide a measure of adjustment so that the visor 20 may be positioned in a spaced apart relationship with respect to the helmet 10 to thereby allow air to pass below the visor 20 and between the visor and the helmet. In this fashion, air pressure on the visor is reduced allowing the rider to move the helmet without fear of having the visor catch the wind and pull the helmet off his head.

The visor 20 is attached to the helmet by means of a friction member 26 located on each side of the helmet. The friction member 26 locks the visor 20 to the helmet 10 by means of the screws 22 in any preferred position required by the user. The visor 20 is bifurcated meaning it is divided into two branches or parts that are breakably attached to the helmet by means of the elongated opening 24. In addition the elongated opening 24 provides a weak point in the connection between the visor 20 and the helmet 10 thereby allowing the visor to break free from the visor in the event of an accident and in this way prevent injury to the user.

The visor 20 which is also illustrated in FIGS. 1, 2, 3 and 4 is preferably constructed of a poly-etheylene material having a hollow central portion 30 for holding a small quantity of fluid. Located on the outermost surface of the visor 20 is a sealing cap 32 which is removeable to allow the user to fill the visor with fluid and when closed is adapted to seal the contents of the visor thereby preventing the fluid from being removed by accident.

A suitable flexible hose 34 is sealed at one end 36 within the visor 20 and terminates at the other end 38. End 38 contains a shoulder portion 40 which allows the motorcycle rider to hold the end 38 in his mouth with the shoulder 40 against his teeth thereby preventing the end 38 from falling out during the excitement of maneuvering his motorcycle.

The flexible tube 34 is adapted to be removeably attached to the open face contour of the helmet 10 along surface 18 by means of removeable clips 42.

The visor 20 will typically hold between 8 to 10 oz. of liquid which is sufficient to allow the rider to keep his mouth moist for a motorcross race of approximately 30 minutes. Water will not generally flow through the tube because of the sealed cap 32, thereby requiring the driver to cause a suction on the tube before any water can be drawn out. Experience has shown that the average rider needs to moisten his mouth with approximately 2 to 3 oz. of water every 15 minutes. A visor 20 having approximately 8 to 10 oz. of water should last the average rider for almost 1 hour depending on his actual need and consumption of the fluid.

The motorcycle rider may moisten his mouth without removing his hands from the handlebars and in this way stay alert and be comfortable under the pressures of temperature and dust while maneuvering his motorcycle.

For longer races, it is customary for motorcycle riders to stop approximately every 40 miles which takes approximately 45 minutes to 60 minutes. At the pitstop, it is a simple matter to open the sealing cap 32, refill the visor with liquid, close the cap and send the rider on his way.

The fluid visor 20 has proven very successful and has been widely accepted by motorcycle racing drivers and particularly in the southwest portion of the country.

I claim:

1. An accessory for attachment to a helmet comprising:

a hollow visor capable of holding a fluid and adapted to be removably connected to a helmet, a removable sealing cover on said visor for allowing liquid to be inserted within said visor and sealed, a flexible tube having one free end adapted to be inserted in the mouth of the helmet user and the other end sealed within said visor.

2. An accessory according to claim 1 in which said visor has bifurcated portions breakably attached to said helmet.

3. An accessory according to claim 2 in which said bifurcated portions have the same contour as the helmet thereby allowing a streamlined flow of air across the visor and over the helmet.

4. An accessory according to claim 3 in which said attachment portions between the visor and the helmet holds the visor in a fixed spaced apart relationship with the helmet thereby allowing air to pass between the visor and the helmet.

5. An accessory according to claim 1 in which said flexible tube is sealed within said visor at the lowest portion thereby insuring that all fluid can be withdrawn when needed.

6. An accessory according to claim 1 in which said free end of said flexible tube has a shoulder portion for allowing the user to hold the end portion with his teeth when wearing the helmet.

7. An accessory according to claim 1 which includes a helmet having a open face portion and in which said flexible tube is removably attached to the periphery of the face portion of the helmet.

8. In combination:

a hollow visor capable of holding a fluid removably attached to a helmet, a removable sealing cover on said visor for allowing liquid to be inserted within said visor and sealed, said visor having bifurcated portions breakably attached to said helmet, said helmet having a contoured open face portion, a flexible tube having one free end adapted to be inserted in the mouth of the helmet wearer and the other end sealed within said visor, and said flexible tube being removably attached to the contoured open face portion of said helmet.

9. A combination according to claim 8 in which said bifurcated portions have the same contour as the helmet thereby allowing a streamlined flow of air across the visor and over the helmet.

10. A combination according to claim 9 in which said attachment portions between the visor and the helmet holds the visor in a fixed spaced apart relationship with the helmet thereby allowing air to pass between the visor and the helmet.

11. A combination according to claim 8 in which said flexible tube is sealed within said visor at the lowest portion thereby insuring that all fluid can be withdrawn when needed.

* * * * *